United States Patent [19]

Navarrette

[11] Patent Number: 5,038,434

[45] Date of Patent: Aug. 13, 1991

[54] BED SUPPORTED TRAY APPARATUS

[76] Inventor: Philip F. Navarrette, 300 E. Fernfield, Monterey Park, Calif. 91754

[21] Appl. No.: 657,415

[22] Filed: Feb. 19, 1991

[51] Int. Cl.[5] ..... A47B 23/02

[52] U.S. Cl. ..... 5/507; 5/426; 108/49

[58] Field of Search ..... 5/507, 505, 506, 503, 5/508; 108/49, 43

[56] References Cited

U.S. PATENT DOCUMENTS

| | | | |
|---|---|---|---|
| 1,957,165 | 5/1934 | Gingras | 108/49 |
| 2,409,495 | 10/1946 | Kelley | 108/49 |
| 2,859,454 | 4/1958 | Beckwell | 5/426 |
| 3,196,468 | 7/1965 | McWilliams | 5/505 |
| 3,276,731 | 10/1966 | Orchard | 108/49 |
| 4,819,568 | 4/1989 | Coffrin | 108/43 |
| 4,841,589 | 6/1989 | Moore | 5/505 |

FOREIGN PATENT DOCUMENTS

| | | | |
|---|---|---|---|
| 911066 | 6/1946 | France | 108/43 |
| 489267 | 7/1938 | United Kingdom | 108/49 |

*Primary Examiner*—Alexander Grosz
*Attorney, Agent, or Firm*—Leon Gilden

[57] ABSTRACT

A bed supported tray apparatus includes a planar support plate defined by a rear and forward end edge and spaced parallel side edges. First and second mounting flanges are mounted adjacent the end edge on the respective first and second side edges mounted orthogonally relative to a top surface of a support plate, with a planar support tray fixedly mounted to upper terminal ends of the mounting flanges and oriented parallel to the top surface of the support plate, with a perimeter flange formed coextensively about a perimeter portion of the support tray extending above the top surface of the support tray for mounting the relation between an upper and lower mattress of a bed structure. Modifications of the invention include pivot legs mounted to the top surface of the support plate to provide enhanced stability to the organization when positioned between the upper and lower mattress.

4 Claims, 4 Drawing Sheets

2
PRIOR ART

BED SUPPORTED TRAY APPARATUS

BACKGROUND OF THE INVENTION

1. Field of the Invention

The field of invention relates to bed and tray apparatus, and more particularly pertains to a new and improved bed supported tray apparatus wherein the same is arranged for positioning and mounted between upper and lower mattress portions of an associated bed structure.

2. Description of the Prior Art

Bed supported tray apparatus of various types are utilized in the prior art for convenience of individuals for convenience or by necessity availing themselves of a tray structure mounted in association with a bed to position various objects thereon, such as food, entertainment devices and the like. Examples of such bed supported tray apparatus in the prior art is exemplified in U.S. Pat. No. 1,719,614 to McIntosh wherein a tray structure is mounted to opposed slider members mounted to the frame portions of a bed.

U.S. Pat. No. 3,054,122 to Sackus sets forth a tray member mounted to a support post and in turn mounted to a guide rod secured to a frame of a bed structure.

U.S. Pat. No. 2,409,495 to Kelley sets forth a table structure arranged for mounting overlying an upper mattress portion of a bed.

U.S. Pat. No. 1,957,165 to Gingras sets forth a table mounted to an associated frame portion of a bed structure.

U.S. Pat. No. 3,276,731 to Orchard provides for a table and tray organization arranged for support to a top surface of a mattress.

As such, it may be appreciated that there continues to be a need for a new and improved bed supported tray apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bed supported tray apparatus now present in the prior art, the present invention provides a bed supported tray apparatus wherein the same is conveniently mounted between an upper and lower mattress portion of a bed organization. As such, the general purpose of the present invention, which will be described subsequently in greater detail, is to provide a new and improved bed supported tray apparatus which has all the advantages of the prior art bed supported tray apparatus and none of the disadvantages.

To attain this, the present invention provides a bed supported tray apparatus including a planar support plate defined by a rear and forward end edge and spaced parallel side edges. First and second mounting flanges are mounted adjacent the end edge on the respective first and second side edges mounted orthogonally relative to a top surface of a support plate, with a planar support tray fixedly mounted to upper terminal ends of the mounting flanges and oriented parallel to the top surface of the support plate, with a perimeter flange formed coextensively about a perimeter portion of the support tray extending above the top surface of the support tray for mounting the relation between an upper and lower mattress of a bed structure. Modifications of the invention include pivot legs mounted to the top surface of the support plate to provide enhanced stability to the organization when positioned between the upper and lower mattress.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed supported tray apparatus which has all the advantages of the prior art bed supported tray apparatus and none of the disadvantages.

It is another object of the present invention to provide a new and improved bed supported tray apparatus which may be easily and efficiently manufactured and marketed.

It is a further object of the present invention to provide a new and improved bed supported tray apparatus which is of a durable and reliable construction.

An even further object of the present invention is to provide a new and improved bed supported tray apparatus which is susceptible of a low cost of manufacture with regard to both materials and labor, and Which accordingly is then susceptible of low prices of sale to the consuming public, thereby making such bed supported tray apparatus economically available to the buying public.

Still yet another object of the present invention is to provide a new and improved bed supported tray apparatus which provides in the apparatuses and methods of the prior art some of the advantages thereof, while simultaneously overcoming some of the disadvantages normally associated therewith.

Still another object of the present invention is to provide a new and improved bed supported tray apparatus wherein the same is arranged for selective securement to an upper and lower mattress portion of a bed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
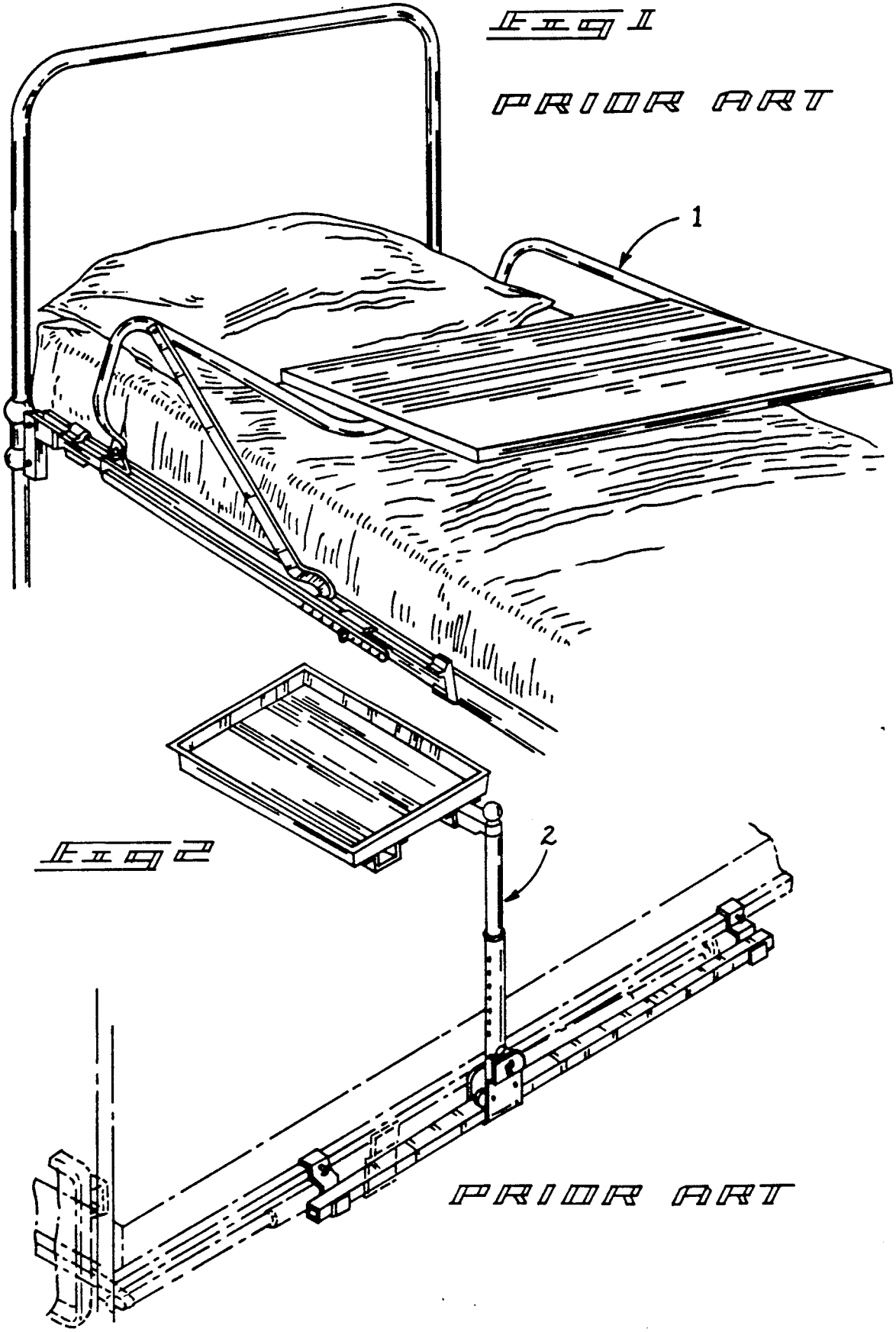
Fig 1 PRIOR ART
FIG. 1 is an isometric illustration of a prior art bed supported tray apparatus.
FIG. 2 is an isometric illustration of a further example of a bed supported tray apparatus.
Figure 3:
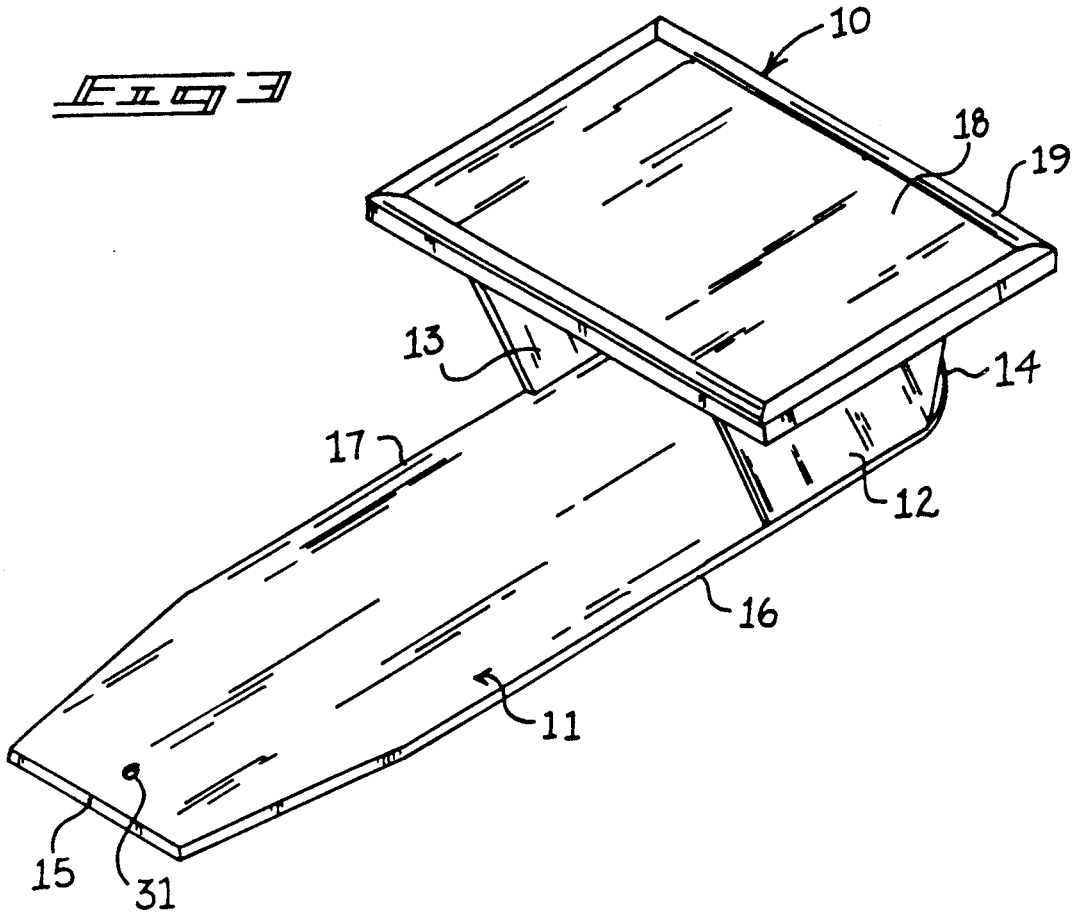
FIG. 3 is an isometric illustration of the instant invention.
Figure 4:
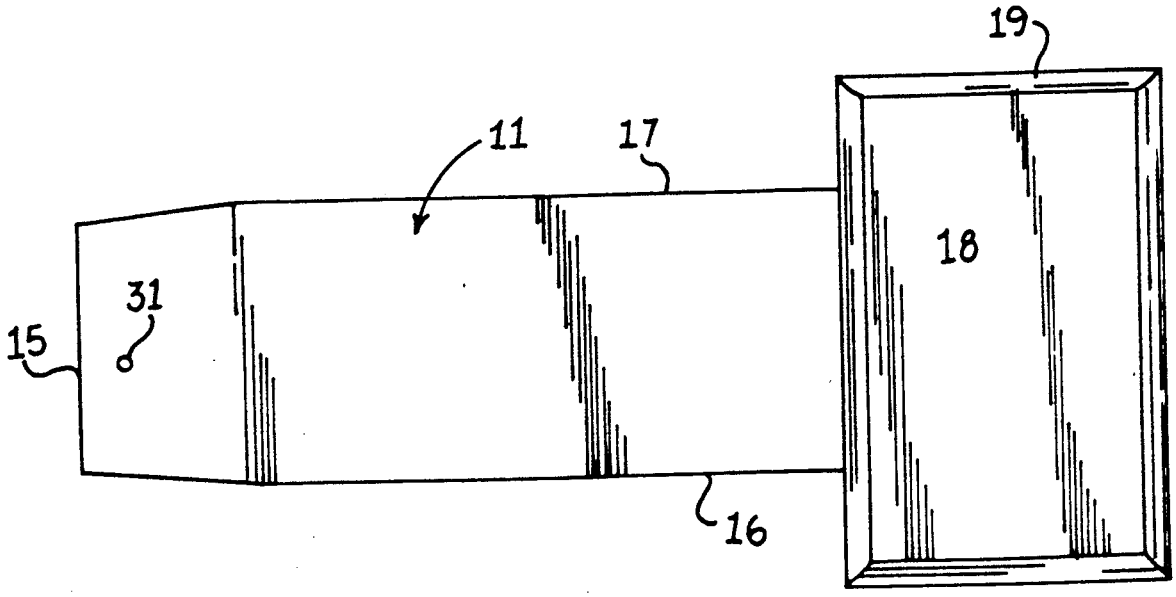
FIG. 4 is a top orthographic view of the instant invention.

With reference now to the drawings, and in particular to FIGS. 1 to 8 thereof, a new and improved bed supported tray apparatus embodying the principles and concepts of the present invention and generally designated by the reference numeral 10 will be described.

FIG. 1 illustrates a prior art bed supported tray organization 1, as set forth in U.S. Pat. No. 1,719,614, wherein the tray structure is mounted to opposed side rails of a bed in a sliding relationship thereto.

FIG. 2 illustrates a further example of a prior art bed supported tray apparatus 2, as set forth in U.S. Pat. No. 3,054,122, wherein a vertical telescoping leg is mounted to a horizontal mounting post that in turn is secured to a side rail of a bed, and a vertical post supports a tray at its upper terminal end.

Figure 5:
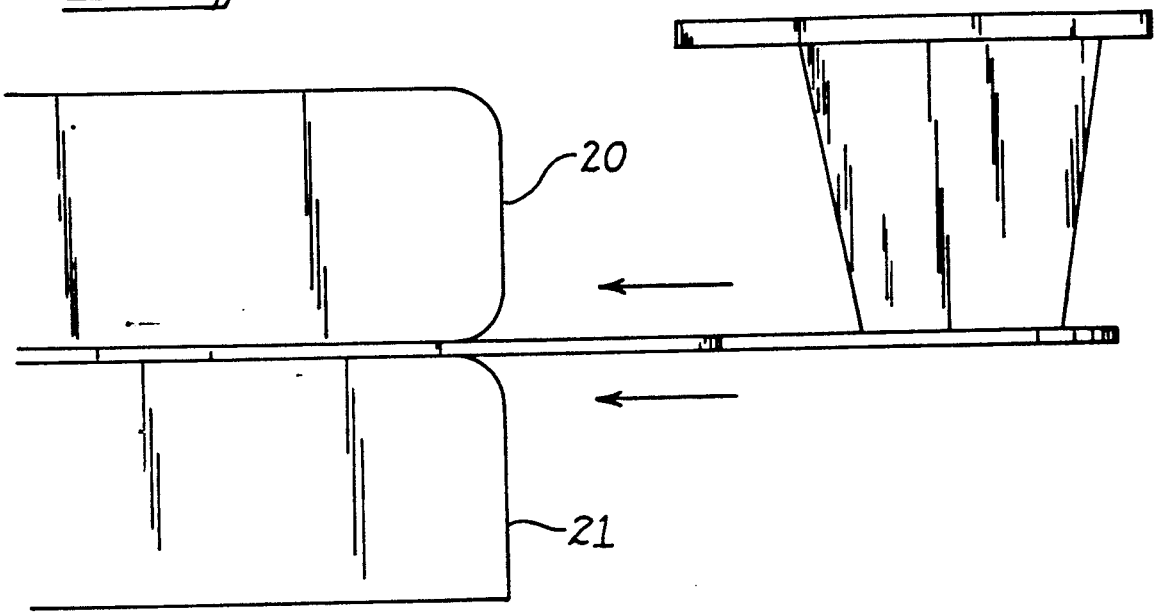
FIG. 5 is an orthographic side view of the instant invention mounted between an upper and lower mattress of a bed structure.

More specifically, the bed supported tray apparatus 10 of the instant invention essentially comprises an elongate, planar support plate 11, including a rear end edge 14 spaced from a forward end edge 15, with spaced opposed first and second side edges 16 and 17 respectively. A respective first and second mounting flange 12 and 13 arranged parallel relative to one another and orthogonally and fixedly mounted to the respective first and second side edges 16 and 17 adjacent the rear end edge 14. Fixedly and orthogonally mounted to upper terminal ends of the mounting flanges is a support tray 18. The support tray 18 includes a planar top surface, with a perimeter flange 19 surroundingly secured about the support tray 18 extending above the top surface. The support plate 11, as illustrated in FIG. 5, is arranged for securement between an upper mattress 20 and a lower mattress 21 for securement of the tray apparatus relative to the mattress structure, as illustrated.

Figure 6:
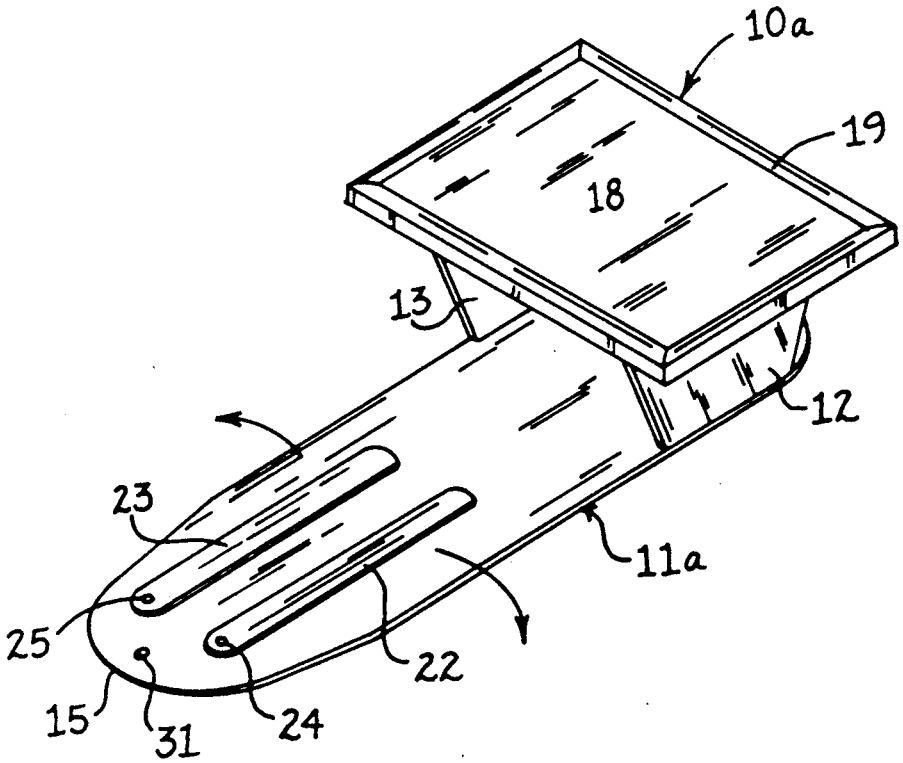
FIG. 6 is an isometric illustration of a modified apparatus set forth by the instant invention.
Figure 7:
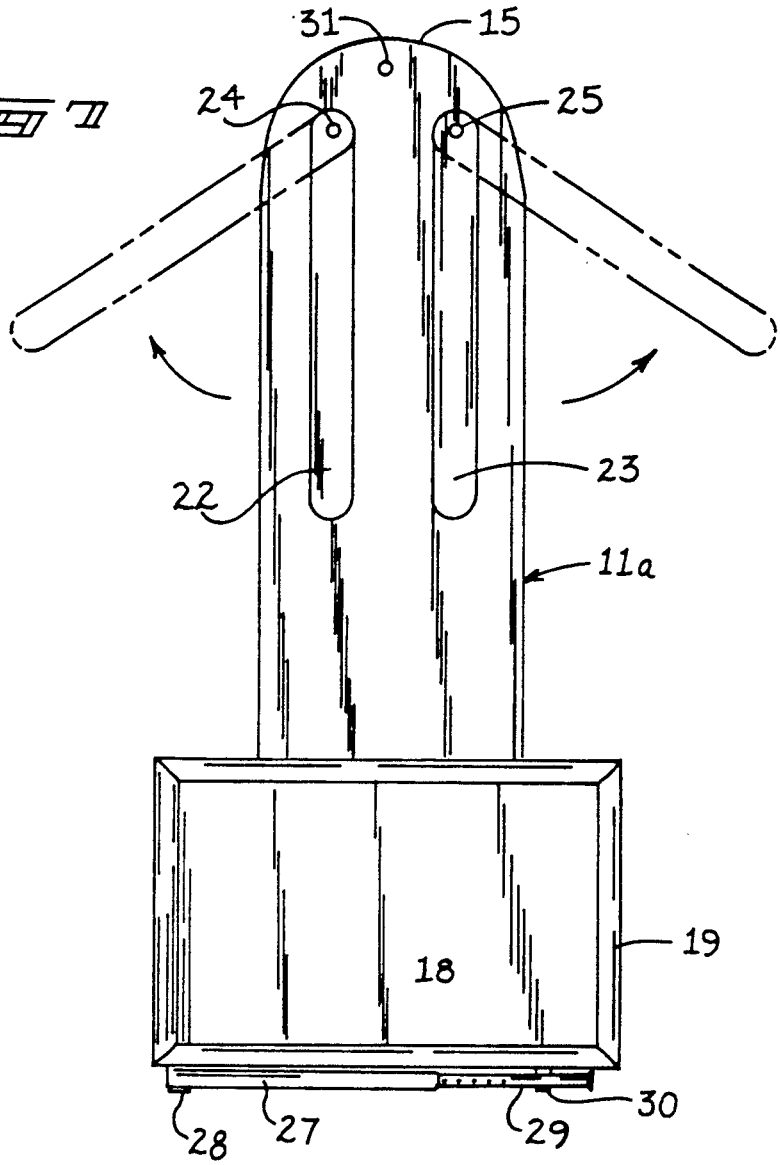
FIG. 7 is an orthographic top view of the modified structure utilized by the instant invention.
Figure 8:
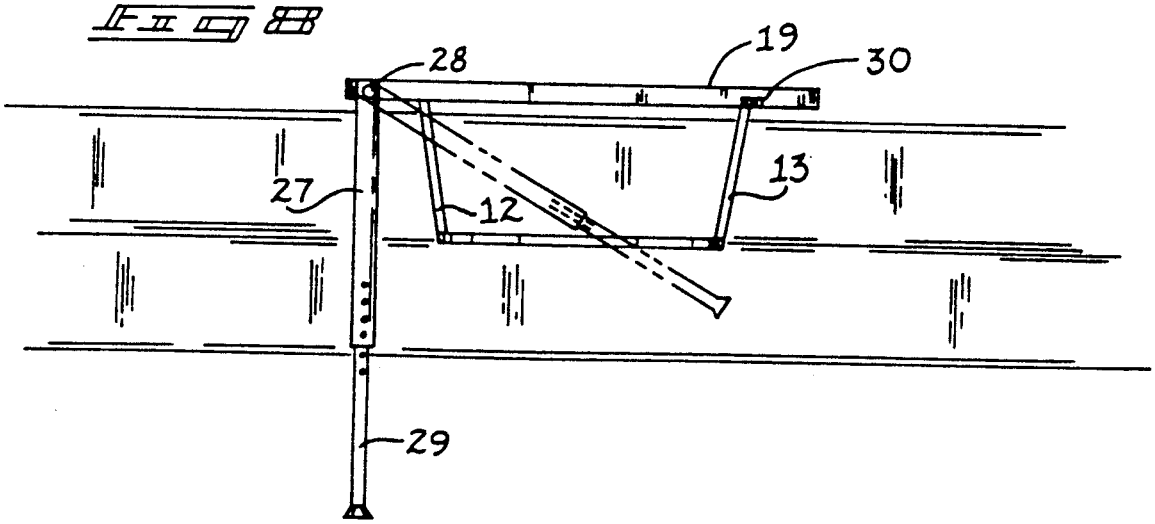
FIG. 8 is an orthographic end view in operative mounting between upper and lower mattress portions of a bed structure.

FIG. 6 illustrates the use of a modified bed supported tray apparatus **10*a* that includes a modified support plate 11*a*, wherein a respective first and second planar pivot leg 22 and 23 is pivotally mounted to a top surface of the support plate 11*a* utilizing a respective first and second pivot axle 24 and 25 directed through each respective first and second planar pivot leg 22 and 23. Each pivot axle is orthogonally and fixedly mounted to the top surface of the modified support plate 11*a* and are arranged parallel relative to one another. The pivot legs 22 and 23 may thereby be extended laterally, wherein they are pivoted to a laterally extended orientation relative to the top surface of the support plate 11*a* from a position overlying the top surface to provide additional stability to the support plate when mounted between the upper and lower mattress 20 and 21. Further, a support leg 27 is provided and includes a leg axle 28 orthogonally and fixedly mounted relative to the perimeter flange 19 and generally parallel to the top surface of the tray 18. A reciprocating leg member 29 is telescopingly received within the support leg 27, wherein an "L" shaped support clip 30 fixedly mounted to the container perimeter flange 19 spaced from the leg axle 28 receives the reciprocating leg member 29 in a raised orientation and removal of the reciprocating leg member 29 relative to the "L" shaped hook 30 for extension imparting stability to the tray structure 18, as well as enhanced load supporting ability. It should be further noted that a mounting aperture 31 is directed through the support plate 11 adjacent the forward end edge 15** to permit the organization to be suspended on a support peg (not shown) during periods of non-use.

It is noted that the support tray 18 is of a generally rectangular configuration, wherein a rear end surface of the perimeter flange 19 orthogonally directed between the first and second sides 16 and 17 receives both the leg axle 28 and the "L" shaped clip 30.

As to the manner of usage and operation of the instant invention, the same should be apparent from the above disclosure, and accordingly no further discussion relative to the manner of usage and operation of the instant invention shall be provided.

With respect to the above Description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bed supported tray apparatus comprising, in combination, a support plate, the support plate including a forward end edge and a rear end edge, and spaced respective first and second side edges, and a first and second mounting flange mounted fixedly to a top surface of the support plate adjacent respective first and second side edges adjacent the rear end edge, and a planar support tray fixedly and orthogonally mounted to upper terminal ends of the respective first and second mounting flange, and the support tray oriented parallel to a top surface of the support plate, and a perimeter flange fixedly secured about a tray perimeter of the support tray, wherein the perimeter flange extends above the support tray, and at least one pivot leg pivotally mounted to said support plate, said pivot leg adapted to be moved between positions overlying the support leg and portions in which the pivot leg extends beyond a side edge of said support plate, the support plate adapted to be removably slid between an upper mattress and a lower mattress of a bed thereby removably positioning the tray relative to the bed.

2. An apparatus as set forth in claim 1 including a lower mattress and an upper mattress, and a support plate directed between the upper mattress and lower mattress.

3. An apparatus as set forth in claim 2 wherein the support plate top surface includes a first pivot axle and a second pivot axle fixedly and orthogonally mounted to the support plate top surface, and the first pivot axle pivotally mounting a planar first pivot leg, and the second pivot axle pivotally mounting a planar second pivot leg, and the first and second pivot legs pivotal from a first position overlying the top surface of the support plate to a second position, wherein the first pivot axle extends beyond the first side edge and the second pivot axle extends beyond the second side edge.

4. An apparatus as set forth in claim 3 wherein the perimeter flange includes a rear flange portion positioned adjacent the rear end edge, and the rear end portion includes a leg axle orthogonally and fixedly mounted thereto, and an "L" shaped clip fixedly mounted thereto spaced from the leg axle, and a support leg pivotally mounted about the leg axle, and the support leg telescopingly receiving a reciprocating leg member when the reciprocating leg member is arranged for relative extension and retraction relative to the support leg and is pivotal from a first leg position, wherein the reciprocating leg member is positioned upon the "L" shaped clip to a second position, wherein the reciprocating leg member is arranged orthogonally relative to the support tray.

* * * * *